US009982650B2

(12) United States Patent
Tanaya

(10) Patent No.: US 9,982,650 B2
(45) Date of Patent: May 29, 2018

(54) IGNITION APPARATUS AND IGNITION CONTROL METHOD

(71) Applicant: Mitsubishi Electric Corporation, Tokyo (JP)

(72) Inventor: Kimihiko Tanaya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 116 days.

(21) Appl. No.: 15/141,968

(22) Filed: Apr. 29, 2016

(65) Prior Publication Data

US 2017/0130689 A1 May 11, 2017

(30) Foreign Application Priority Data

Nov. 5, 2015 (JP) ..... 2015-217388

(51) Int. Cl.

| | |
|---|---|
| ***F02P 11/00*** | (2006.01) |
| ***F02P 3/09*** | (2006.01) |
| ***F02P 9/00*** | (2006.01) |
| *F02P 3/04* | (2006.01) |
| *F02P 3/08* | (2006.01) |
| *F02P 11/02* | (2006.01) |
| *F02P 3/02* | (2006.01) |

(52) U.S. Cl.

CPC ..... *F02P 11/00* (2013.01); *F02P 3/09* (2013.01); *F02P 9/005* (2013.01); *F02P 9/007* (2013.01); *F02P 3/02* (2013.01); *F02P 3/04* (2013.01); *F02P 3/0892* (2013.01); *F02P 11/025* (2013.01)

(58) Field of Classification Search

CPC .... F02P 11/00; F02P 11/02; F02P 3/09; F02P 9/005; F02P 9/007

See application file for complete search history.

(56) References Cited

U.S. PATENT DOCUMENTS

| | | | | |
|---|---|---|---|---|
| 4,195,897 A * | 4/1980 | Plevjak | ..... | H01H 35/14 180/283 |
| 6,483,201 B1 * | 11/2002 | Klarer | ..... | B60K 28/10 307/10.1 |
| 2010/0132666 A1 * | 6/2010 | Sato | ..... | F02P 9/007 123/406.19 |

FOREIGN PATENT DOCUMENTS

| | | |
|---|---|---|
| JP | 56-157381 U | 4/1980 |
| JP | 2010-193691 A | 9/2010 |
| JP | 5295305 B2 | 9/2013 |

OTHER PUBLICATIONS

Communication, dated Jul. 12, 2016, from the Japanese Patent Office in counterpart Japanese application No. 2015-217388.

* cited by examiner

*Primary Examiner* — Jacob Amick

(74) *Attorney, Agent, or Firm* — Sughrue Mion, PLLC; Richard C. Turner

(57) ABSTRACT

Provided are an ignition apparatus and an ignition control method capable of suppressing occurrence of a defect caused by a charge unit, which may occur when ignition of a combustible mixture in a combustion chamber of an internal combustion engine needs to be stopped. When a stop condition for stopping ignition of a combustible mixture in a combustion chamber (2) of an internal combustion engine (1) is satisfied, supply of plasma generation energy to an ignition plug (3) is stopped, and DC energy charged in a charge unit (42) is discharged.

8 Claims, 3 Drawing Sheets

IGNITION APPARATUS AND IGNITION CONTROL METHOD

BACKGROUND OF THE INVENTION

1. Field of the Invention

The present invention relates to an ignition apparatus including an ignition plug configured to ignite a combustible mixture in a combustion chamber of an internal combustion engine and an ignition control method for controlling the ignition apparatus.

2. Description of the Related Art

In recent years, there have been posed problems of environmental conservation and fuel exhaustion, and addressing those problems is an urgent matter in an automotive industry. Thus, as an example of the related art for addressing those problems, there is a technology of using exhaust gas recirculation (EGR) to reduce a pumping loss, to thereby drastically improve fuel efficiency.

However, burnt gas, which is exhaust gas, is large in heat capacity than the air, and hence when a large amount of the burnt gas is sucked again into the combustion chamber through the EGR, there is such a problem that an ignition property and a combustion property of the combustible mixture decrease. Thus, as an example of the related art for solving such a problem, there has been proposed an ignition apparatus in which an ignition plug is configured to generate a spark discharge larger in energy so as to stabilize the ignition property and the combustion property of the combustible mixture (for example, refer to Japanese Patent No. 5295305).

The ignition apparatus described in Japanese Patent No. 5295305 includes a first capacitor having a capacitance of 100 [μF] and a second capacitor having a capacitance of 5 [μF] so as to be able to generate a spark discharge large in energy. Moreover, the ignition apparatus is configured such that the voltage of the first capacitor becomes a higher voltage of 150 [V], and the voltage of the second capacitor becomes a higher voltage of 300 [V].

Here, when the ignition of the combustible mixture needs to be stopped, a defect caused by the capacitors occurs unless the ignition of the combustible mixture is stopped and the energies charged in the capacitors are discharged so as to decrease the voltages of the capacitors. For example, when a collision of a vehicle, on which such ignition apparatus described above is installed, is occurred with an object such as another vehicle, only the stop of the ignition of the combustible mixture is not sufficient, and when the voltages of the capacitors remain to be the higher voltages, for example, a short circuit of terminals may generate a spark as the defect caused by the capacitors.

SUMMARY OF THE INVENTION

The present invention has been made in view of the above-mentioned problem, and therefore has an object to provide an ignition apparatus and an ignition control method capable of suppressing the occurrence of a defect caused by a charge unit, which may occur when the ignition of the combustible mixture needs to be stopped.

According to one embodiment of the present invention, there is provided an ignition apparatus, including: an ignition plug configured to generate plasma so as to ignite a combustible mixture in a combustion chamber of an internal combustion engine; an energy supply unit including: a DC/DC boost unit configured to boost a DC voltage supplied from a DC power supply; a charge unit configured to be applied with the DC voltage boosted by the DC/DC boost unit so as to charge DC energy; and a discharge unit configured to discharge the DC energy charged in the charge unit; and a control unit configured to determine whether or not a stop condition for stopping the ignition of the combustible mixture is satisfied, and control the energy supply unit in accordance with a determination result, in which: the energy supply unit is configured to generate, from the DC energy charged in the charge unit, plasma generation energy for generating the plasma by the ignition plug, and supply the plasma generation energy to the ignition plug; and the control unit is configured to, when determining that the stop condition is satisfied, control the energy supply unit so that the supply of the plasma generation energy to the ignition plug is stopped and the DC energy charged in the charge unit is discharged by the discharge unit.

Further, according to one embodiment of the present invention, there is provided an ignition control method for controlling an energy supply unit configured to generate, from DC energy charged in a charge unit, plasma generation energy for generating plasma by an ignition plug configured to ignite a combustible mixture in a combustion chamber of an internal combustion engine, and to supply the plasma generation energy to the ignition plug, the ignition control method including a control step of determining whether or not a stop condition for stopping the ignition of the combustible mixture is satisfied, and controlling the energy supply unit in accordance with a determination result, in which the control step includes controlling, when determining that the stop condition is satisfied, the energy supply unit so that the supply of the plasma generation energy to the ignition plug is stopped and the DC energy charged in the charge unit is discharged.

According to the embodiments of the present invention, when the stop condition for stopping the ignition of the combustible mixture is satisfied, the supply of the plasma generation energy to the ignition plug is stopped, and the DC energy charged in the charge unit is discharged. Thus, the ignition apparatus and the ignition control method capable of suppressing the occurrence of the defect caused by the charge unit, which may occur when the ignition of the combustible mixture needs to be stopped, can be obtained.

DETAILED DESCRIPTION OF THE PREFERRED EMBODIMENTS

Now, an ignition apparatus and an ignition control method according to exemplary embodiments of the present invention are described referring to the accompanying drawings. In the illustration of the drawings, the same or corresponding components are denoted by the same reference symbols, and the overlapping description thereof is herein omitted.

First Embodiment

Figure 1:
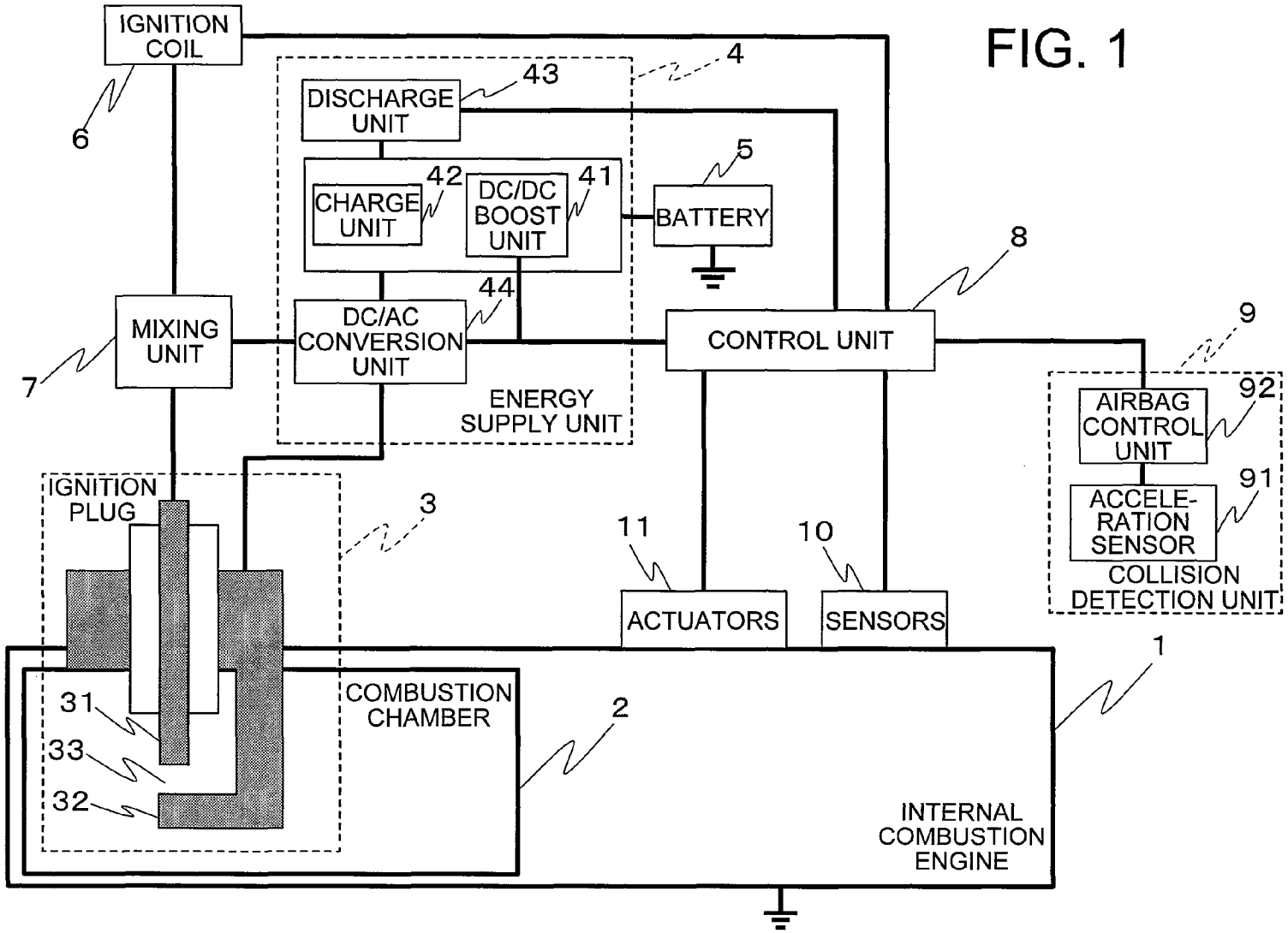
FIG. 1 is a configuration diagram for illustrating an internal combustion engine system including an ignition apparatus according to a first embodiment of the present invention.

FIG. 1 is a configuration diagram for illustrating an internal combustion engine system including an ignition apparatus according to a first embodiment of the present invention. Note that, according to the first embodiment, a case in which the internal combustion engine system is installed on a motor vehicle, which is an example of a vehicle, is exemplified.

The internal combustion engine system of FIG. 1 includes an internal combustion engine 1 including a combustion chamber 2, a battery 5 as an example of a DC power supply, the ignition apparatus including an ignition plug 3, an energy supply unit 4, an ignition coil 6, a mixing unit 7, a control unit 8, and a collision detection unit 9, sensors 10, and actuators 11.

The ignition plug 3 includes a first electrode 31 and a second electrode 32 opposed to each other via a gap 33. The ignition plug 3 generates plasma in the gap 33, to thereby ignite a combustible mixture in the combustion chamber 2 of the internal combustion engine 1.

The energy supply unit 4 includes a DC/DC boost unit 41, a charge unit 42, a discharge unit 43, and a DC/AC conversion unit 44. The DC/DC boost unit 41 boosts a DC voltage supplied from the battery 5. The charge unit 42 is applied with the DC voltage boosted by the DC/DC boost unit 41 so as to charge DC energy.

The discharge unit 43 discharges the DC energy charged in the charge unit 42. The DC/AC conversion unit 44 converts the supplied DC energy into AC energy.

The energy supply unit 4 generates, from the DC energy charged in the charge unit 42, plasma generation energy for generating the plasma by the ignition plug 3. Specifically, the energy supply unit 4 uses the AC energy acquired by the DC/AC conversion unit 44 converting the DC energy as the plasma generation energy. Moreover, the energy supply unit 4 supplies the generated plasma generation energy to the ignition plug 3.

The ignition coil 6 supplies DC energy for generating a spark discharge by the ignition plug 3. Specifically, the ignition coil 6 supplies the DC current to the first electrode 31 of the ignition plug 3 via the mixing unit 7, to thereby generate a high voltage higher than a breakdown voltage of the combustible mixture in the gap 33. In this way, the generation of the high voltage in the gap 33 of the ignition plug 3 generates plasma, namely, the spark discharge, in the gap 33.

The mixing unit 7 suppresses the inflow of the DC energy, which is supplied from the ignition coil 6 to the spark plug 3, to the energy supply unit 4.

The control unit 8 is realized by, for example, a CPU configured to execute programs stored in a memory, and a processing circuit such as a system LSI. The control unit 8 controls an operation of the internal combustion engine 1. As a control method for the internal combustion engine 1 performed by the control unit 8, as widely known, various control methods are conceivable. For example, the control unit 8 uses the actuators 11 to drive the internal combustion engine 1 based on detection results input from the sensors 10 configured to detect travel states of the vehicle.

The control unit 8 also controls operations of the energy supply unit 4 and the ignition coil 6 in addition to the internal combustion engine 1. The control unit 8 calculates, based on the detection results obtained by the sensors 10 and operation states of the actuators 11, an appropriate timing and an appropriate period for generating the plasma in the gap 33 of the ignition plug 3. The control unit 8 controls the energy supply unit 4 and the ignition coil 6 in order to realize the generation of the plasma based on the calculation results.

Specifically, the control unit 8 controls the ignition coil 6 so as to start accumulation of the energy, and to supply the DC energy to the ignition plug 3 at the timing of the generation of the plasma. The ignition coil 6 follows the control by the control unit 8 to supply the DC energy to the ignition plug 3, to thereby generate the plasma in the gap 33.

On this occasion, when the combustible mixture in the combustion chamber 2 contains a large amount of EGR gas, the combustible mixture is not ignited only by the plasma generated by the DC energy supplied from the ignition coil 6 to the ignition plug 3.

Thus, the control unit 8 controls the ignition coil 6 so that the DC energy is supplied from the ignition coil 6 to the ignition plug 3, and also controls the energy supply unit 4 so that the plasma generation energy is supplied from the energy supply unit 4 to the ignition plug 3. In this way, the additional supply of the plasma generation energy to the ignition plug 3 enables the ignition of the combustible mixture.

Moreover, the control unit 8 determines whether or not a stop condition for stopping the ignition of the combustible mixture is satisfied, and follows the determination result to control the operation of the energy supply unit 4.

When the control unit 8 determines that the stop condition is not satisfied, as described above, the control unit 8 continues the drive of the energy supply unit 4 so that the combustible mixture can be ignited. On the other hand, when the control unit 8 determines that the stop condition is satisfied, the control unit 8 controls the energy supply unit 4 to stop the supply of the plasma generation energy to the ignition plug 3 so that the combustible mixture cannot be ignited.

The collision detection unit 9 detects a collision of the vehicle, on which the internal combustion engine is installed, with an object such as another vehicle, and outputs a collision detection result to the control unit 8. Specifically, the collision detection unit 9 is constructed by an acceleration sensor 91 and an airbag control unit 92.

The acceleration sensor 91 detects rapid deceleration of the vehicle, which occurs when the collision of the vehicle occurs, and, when the acceleration sensor 91 detects rapid deceleration of the vehicle, outputs a detection result to the airbag control unit 92.

The airbag control unit 92 controls an airbag mechanism (not shown) installed on the vehicle. When the airbag control unit 92 inputs the detection result representing rapid deceleration of the vehicle from the acceleration sensor 91, the airbag control unit 92 outputs an airbag operation signal to the airbag mechanism. When the airbag mechanism inputs the airbag operation signal from the airbag control unit 92, the airbag mechanism operates.

Moreover, the airbag control unit 92 also outputs the airbag operation signal to the control unit 8 in addition to the airbag mechanism. The airbag control unit 92 outputs the airbag operation signal as a collision detection result to the control unit 8. When the airbag operation signal is input from the airbag control unit 92, the control unit 8 determines that the stop condition is satisfied. On the other hand, when the airbag operation signal is not input from the airbag control unit 92, the control unit 8 determines that the stop condition is not satisfied.

Note that, the functions of the airbag control unit 92 may be built into the control unit 8. In this case, the detection result obtained by the acceleration sensor 91 is directly input to the control unit 8, and the control unit 8 carries out the same operation as that of the airbag control unit 92.

Moreover, the case in which the collision detection unit 9 is constructed by the acceleration sensor 91 and the airbag control unit 92 is exemplified, but the configuration is not limited to this case, and the collision detection unit 9 may be configured in any way as long as the collision detection unit 9 can detect the collision of the vehicle.

Moreover, the case in which the control unit 8 is configured to determine whether or not the stop condition is satisfied depending on whether or not the collision detection result is input from the collision detection unit 9 is exemplified, but the configuration is not limited to this case. In other words, the condition used by the control unit 8 to determine whether or not the stop condition is satisfied is not limited to whether or not the collision detection result is input from the collision detection unit 9, and can be arbitrarily determined.

For example, the control unit 8 may be configured to determine that the stop condition is satisfied when the energy supply unit 4 may be damaged. Moreover, the control unit 8 may be configured to determine that the stop condition is satisfied when a hood of the vehicle is open.

Figure 2:
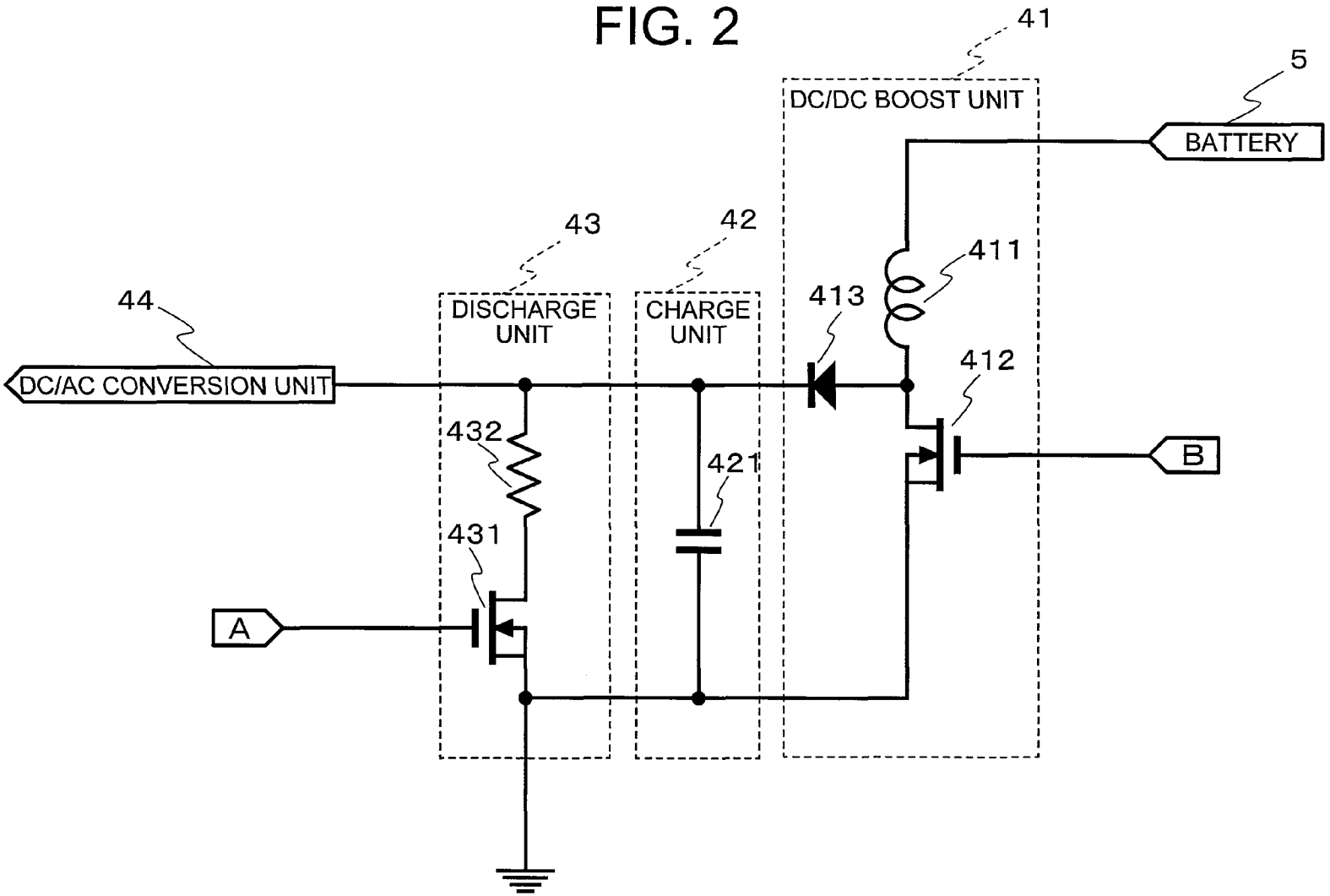
FIG. 2 is a circuit configuration diagram for illustrating an energy supply unit according to the first embodiment of the present invention.

Referring to FIG. 2, a description is now given of an example of a circuit configuration of the energy supply unit 4. FIG. 2 is a circuit diagram for illustrating the energy supply unit 4 according to the first embodiment of the present invention. Note that, in FIG. 2, both the above-mentioned battery 5 and a terminal A and a terminal B described later are illustrated as well as the circuit configuration.

In FIG. 2, the DC/DC boost unit 41 is constructed by a general DC/DC boost circuit including an inductor 411, a switching device 412 such as a MOSFET, and a diode 413. Note that, the DC/DC boost unit 41 is designed to boost the DC voltage supplied from the battery 5 to a value of, for example, 100 [V] or more and 200 [V] or less. While the stop condition is not satisfied, the control unit 8 inputs a control signal from the terminal B to the switching device 412 so as to apply control of switching the switching device 412 to on or off, to thereby boost the DC voltage supplied from the battery 5. On the other hand, when the stop condition is satisfied, the control unit 8 stops the drive of the DC/DC boost unit 41. In other words, the control unit 8 stops the switching of the switching device 412, to thereby stop the boost of the DC voltage. In this way, when the drive of the energy supply unit 4 is stopped, the combustible mixture cannot be ignited.

The charge unit 42 is constructed by a capacitor 421 to be applied with the DC voltage boosted by the DC/DC boost unit 41 so as to charge the DC energy. The DC/AC conversion unit 44 is constructed by a general DC/AC conversion circuit, and converts the DC energy charged in the capacitor 421 to AC energy.

The discharge unit 43 is constructed by, for example, a switching device 431, such as a MOSFET, and a resistor 432 serially connected to each other.

While the stop condition is not satisfied, the control unit 8 controls the switching device 431 to be off. In this case, the DC energy charged in the capacitor 421 is input to the DC/AC conversion unit 44.

On the other hand, when the stop condition is satisfied, the control unit 8 inputs the control signal from the terminal A to the switching device 431, to thereby switch the switching device 431 from off to on. Moreover, when the switching device 431 is switched from off to on, the DC energy charged in the capacitor 421 is discharged via the resistor 432, and is thus not input to the DC/AC conversion unit 44. In this way, when the control unit 8 determines that the stop condition is satisfied, the control unit 8 controls the switching device 431 to switch from off to on so that the DC energy is discharged from the charge unit 43 via the resistor 432.

A description is now further given of a case in which the configuration of FIG. 2 is employed as the circuit configuration of the energy supply unit 4.

On this occasion, in general, a voltage equal to or more than 60 [V] can cause an electric shock, which depends on the situation. Thus, considering a safety factor, when a charge voltage of the charge unit is equal to or more than 48 [V], a measure for suppressing the electric shock is necessary. In other words, when the DC voltage boosted by the DC/DC boost unit 41 is equal to or more than 48 [V], this measure is necessary. In contrast, according to the first embodiment, this measure is realized by providing the discharge unit 43 in the energy supply unit 4.

For example, when the DC voltage boosted by the DC/DC boost unit 41 is designed to be 100 [V], the charge voltage of the capacitor 421 is also 100 [V].

Moreover, when the resistance of the resistor 432 of the discharge unit 43 is represented by R [Ω], the capacitance of the capacitor 421 of the charge unit 42 is represented by C [F], and a time constant is represented by τ [s], the resistance R and the capacitance C are preferably designed to satisfy Expression (1). Note that, when a plurality of capacitors 421 are used to construct the charge unit 42, a total capacitance of the plurality of capacitors is the capacitance C.

$$\tau \leq 60, \text{ where } \tau = R \times C \quad (1)$$

For example, in Expression (1), when the capacitance C is 100 [μF], the resistance R is determined so as to satisfy Expression (2).

$$R\ [\Omega] \times 100 \times 10^{-6}\ [F] \leq 60\ [s]$$

$$R \leq 600\ [k\Omega] \quad (2)$$

Note that, how to determine the resistance R of the resistor 432 is not limited to the above-mentioned method, and the resistance R may be determined by the following method. On this occasion, a discharge period taken by the discharge unit 43 to discharge the DC energy charged in the capacitor 421 is preferably as short as possible. On the other hand, when the discharge period is too short, an excessive current flows through the switching device 431 and the resistor 432, and these devices may be damaged. Consequently, for example, a short circuit, a spark generated in the circuit, or an abnormal overheat can be generated. Thus, the discharge period is preferably designed so as not to damage the switching device 431 and the resistor 432.

For example, it is assumed that the switching device 431 is a MOSFET, a pulse current rated value of the MOSFET is 50 [A], and a drain-source conduction resistance is 100 [mΩ)]. Moreover, it is assumed that the charge voltage of the capacitor 421 is 100 [V]. In this case, the resistance R is determined so as to satisfy Expression (3). When the resistance R is determined so as to satisfy Expression (3), the current flowing through the MOSFET is not more than the pulse current rated value, and consequently, the MOSFET is prevented from being damaged.

$$R\ [\Omega] + 100 \times 10^{-3}\ [\Omega] \geq 100\ [V] \div 50\ [A]$$

$$R \geq 1.9\ [\Omega] \quad (3)$$

Moreover, when the resistance R is 1.9 [Ω], a large power of 4.75 [kW] is momentarily generated in the resistor 432. On this occasion, considering that the switching device 431 is on only when the stop condition is satisfied and the switching device 431 does not periodically repeat on and off, it is conceivable that the resistor 432 having a relatively high rated power does not need to be used. However, when the switching device 431 is on even momentarily, a high power is generated in the resistor 432, and hence the resistor 432 having a rated power of at least 0.5 [W] is preferably used.

Figure 3:
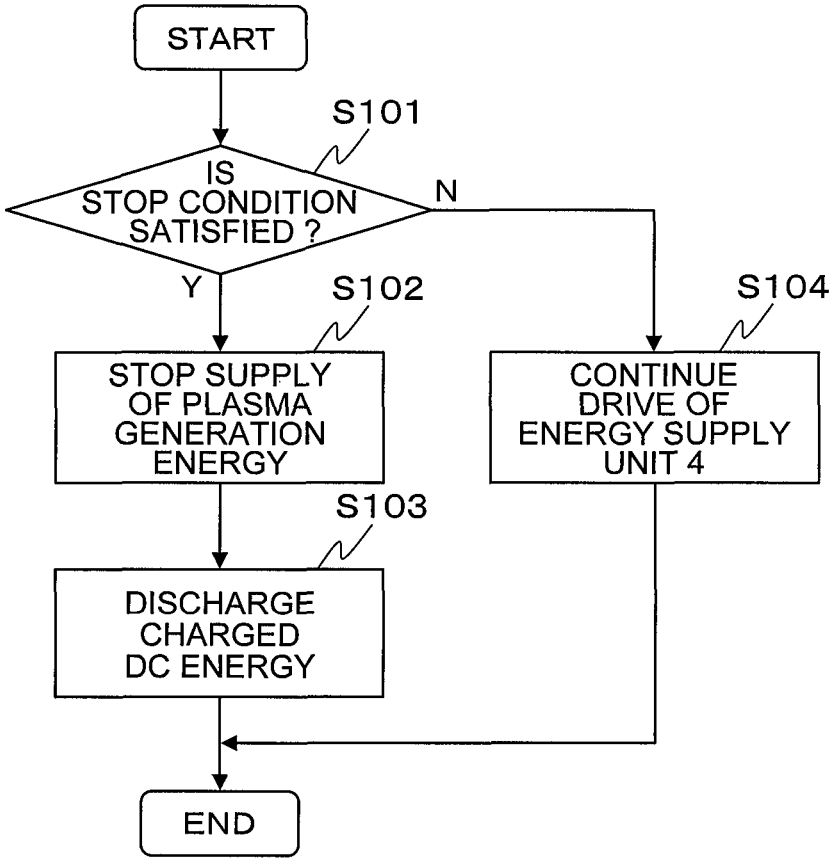
FIG. 3 is a flowchart for illustrating a sequence of an operation of the ignition apparatus according to the first embodiment of the present invention.

Referring to FIG. 3, a description is now given of a sequence of an operation of the ignition apparatus according to the first embodiment. FIG. 3 is a flowchart for illustrating the sequence of the operation of the ignition apparatus according to the first embodiment of the present invention.

Note that, the processing of the flowchart of FIG. 3 is carried out at, for example, a predetermined timing.

In Step S101, the control unit 8 determines whether or not the stop condition is satisfied. When the control unit 8 determines that the stop condition is satisfied, the control unit 8 proceeds to Step S102. When the control unit 8 determines that the stop condition is not satisfied, the control unit 8 proceeds to Step S104.

In Step S102, the control unit 8 controls the energy supply unit 4 so as to stop the supply of the plasma generation energy to the ignition plug 3, and proceeds to Step S103.

In Step S103, the control unit 8 controls the energy supply unit 4 so that the DC energy charged in the charge unit 42 is discharged by the discharge unit 43, and finishes the sequence of processing.

In Step S104, the control unit 8 continues the drive of the energy supply unit 4, and finishes the sequence of processing.

Note that, in FIG. 3, a case in which Step S103 is carried out after Step S102 is carried out is exemplified, but Step S102 and Step S103 may be simultaneously carried out. Moreover, after Step S103 is carried out, Step S102 may be carried out. Further, while the plasma generation energy is being supplied to the ignition plug 3, when the control unit 8 determines that the stop condition is satisfied, Step S102 may be carried out preferentially.

Note that, only the plasma generation energy supplied from the energy supply unit 4 to the ignition plug 3 may be used by the ignition plug 3 to generate the plasma, to thereby ignite the combustible mixture. In this case, the ignition coil 6 and the mixing unit 7 do not need to be provided in the ignition apparatus.

Without the conversion of the DC energy charged in the charge unit 42 into the AC energy by the DC/AC conversion unit 44, the DC energy may be directly supplied to the ignition plug 3 as the plasma generation energy. In this case, the DC/AC conversion unit 44 does not need to be provided in the ignition device.

As described above, according to the first embodiment, when the stop condition for stopping the ignition of the combustible mixture is satisfied, the supply of the plasma generation energy to the ignition plug is stopped, and the DC energy charged in the charge unit is discharged. As a result, the occurrence of the defect caused by the charge unit, which may occur when the ignition of the combustible mixture in the combustion chamber of the internal combustion engine needs to be stopped, can be suppressed.

Moreover, in the above-mentioned configuration, when the collision of the vehicle on which the internal combustion engine is installed is detected, the stop condition for stopping the ignition of the combustible mixture is determined to be satisfied. As a result, even when the vehicle on which the charge unit such as the capacitor accumulating the electric energy at the high voltage is installed is involved in a collision accident or the like, and the charge unit is consequently damaged, the occurrence of the defect caused by the charge unit can be suppressed.

What is claimed is:

1. An ignition apparatus, comprising:

an ignition plug configured to generate plasma so as to ignite a combustible mixture in a combustion chamber of an internal combustion engine;

an energy supply unit comprising:

a DC/DC boost unit configured to boost a DC voltage supplied from a DC power supply;

a charge unit configured to be applied with the DC voltage boosted by the DC/DC boost unit so as to charge DC energy; and a discharge unit configured to discharge the DC energy charged in the charge unit; and a control unit configured to determine whether or not a stop condition for stopping the ignition of the combustible mixture is satisfied, and control the energy supply unit in accordance with a determination result, wherein:

the energy supply unit is configured to generate, from the DC energy charged in the charge unit, plasma generation energy for generating the plasma by the ignition plug, and supply the plasma generation energy to the ignition plug;

the control unit is configured to, when determining that the stop condition is satisfied, control the energy supply unit so that the supply of the plasma generation energy to the ignition plug is stopped and the DC energy charged in the charge unit is discharged by the discharge unit;

the energy supply unit further comprises a DC/AC conversion unit configured to convert the DC energy to AC energy; and the energy supply unit is configured to supply the AC energy acquired by converting the DC energy by the DC/AC conversion unit as the plasma generation energy.

2. An ignition apparatus according to claim 1, wherein the energy supply unit is configured to supply the DC energy as the plasma generation energy.

3. An ignition apparatus according to claim 1, further comprising a collision detection unit configured to detect a collision of a vehicle on which the internal combustion engine is installed, wherein the control unit is configured to determine that the stop condition is satisfied when the collision detection unit detects the collision.

4. An ignition apparatus according to claim 1, wherein:

the discharge unit comprises a resistor and a switching device serially connected to each other; and the control unit is configured to control, when determining that the stop condition is satisfied, the switching device to switch from off to on so that the DC energy is discharged from the charge unit via the resistor.

5. An ignition apparatus according to claim 4, wherein:

the charge unit comprises a capacitor; and when a resistance of the resistor is represented by R [Ω], a capacitance of the capacitor is represented by C [F], and a time constant is represented by τ [s], the resistance and the capacitance satisfy the following relational expression:

$$\tau \leq 60, \text{ where } \tau = R \times C.$$

6. An ignition apparatus according to claim 1, wherein a value of the DC voltage boosted by the DC/DC boost unit is equal to or more than 48 [V].

7. An ignition control method for controlling an energy supply unit configured to generate, from DC energy charged in a charge unit, plasma generation energy for generating plasma by an ignition plug configured to ignite a combustible mixture in a combustion chamber of an internal combustion engine, and to supply the plasma generation energy to the ignition plug, the ignition control method comprising a control step of determining whether or not a stop condition for stopping the ignition of the combustible mixture is satisfied, and controlling the energy supply unit in accordance with a determination result, wherein the control step comprises controlling, when determining that the stop condition is satisfied, the energy supply unit so that the supply of the plasma generation energy to the ignition plug is stopped and the DC energy charged in the charge unit is discharged, and wherein when a collision of a vehicle on which the internal combustion engine is installed is detected, determining that the stop condition is satisfied.

8. An ignition apparatus, comprising:

an ignition plug configured to generate plasma so as to ignite a combustible mixture in a combustion chamber of an internal combustion engine;

an energy supply unit comprising:

a DC/DC boost unit configured to boost a DC voltage supplied from a DC power supply;

a charge unit configured to be applied with the DC voltage boosted by the DC/DC boost unit so as to charge DC energy; and a discharge unit configured to discharge the DC energy charged in the charge unit;

a control unit configured to determine whether or not a stop condition for stopping the ignition of the combustible mixture is satisfied, and control the energy supply unit in accordance with a determination result; and a collision detection unit configured to detect a collision of a vehicle on which the internal combustion engine is installed, wherein the control unit is configured to determine that the stop condition is satisfied when the collision detection unit detects the collision, wherein:

the energy supply unit is configured to generate, from the DC energy charged in the charge unit, plasma generation energy for generating the plasma by the ignition plug, and supply the plasma generation energy to the ignition plug;

the control unit is configured to, when determining that the stop condition is satisfied, control the energy supply unit so that the supply of the plasma generation energy to the ignition plug is stopped and the DC energy charged in the charge unit is discharged by the discharge unit; and wherein the control unit is configured to determine that the stop condition is satisfied when the collision detection unit detects the collision.

* * * * *